United States Patent [19]

Insley et al.

[11] 4,057,959

[45] Nov. 15, 1977

[54] DIGITAL TIMER AND METHOD OF OPERATING SUCH

[75] Inventors: Gene L. Insley, Rock Falls; Merle J. Lewis, Morrison, both of Ill.

[73] Assignee: General Electric Company, Fort Wayne, Ind.

[21] Appl. No.: 571,416

[22] Filed: Apr. 24, 1975

Related U.S. Application Data

[62] Division of Ser. No. 464,255, April 25, 1974, Pat. No. 3,898,792.

[51] Int. Cl.[2] ..... G04B 19/02

[52] U.S. Cl. ..... 58/125 C; 58/126 E; 235/133 R

[58] Field of Search ..... 58/39.5, 74, 85.5, 125 C, 58/126 E; 235/133 R

[56] References Cited

U.S. PATENT DOCUMENTS

| | | | |
|---|---|---|---|
| 2,343,613 | 3/1944 | Goldsmith, Jr. | 58/125 C |
| 2,636,339 | 4/1953 | Holzner | 58/85.5 X |
| 2,762,190 | 9/1956 | Holzner | 58/125 C X |
| 2,959,914 | 11/1960 | Harada | 58/85.5 X |
| 3,574,995 | 4/1971 | Turner | 58/125 C |
| 3,590,572 | 7/1971 | Niznik | 58/125 C X |
| 3,609,956 | 10/1971 | Funaki | 58/125 C X |
| 3,611,705 | 10/1971 | Niznik | 58/125 C X |
| 3,807,167 | 4/1974 | Chappatte | 58/125 C |

*Primary Examiner*—Ulysses Weldon
*Attorney, Agent, or Firm*—Joseph E. Papin

[57] ABSTRACT

A digital timer has means operable generally for indicating digital time and means for actuating the indicating means to effect the digital time indicating operation thereof. A drive train is provided for connection with the actuating means and includes means adapted to be intermittently rotatable, means for driving the rotatable means in a predetermined time sequence to effect the intermittent rotation thereof, and means for translating the intermittent rotation of the rotatable means to the actuating means.

A method of operating a digital timer is also disclosed.

14 Claims, 9 Drawing Figures

DIGITAL TIMER AND METHOD OF OPERATING SUCH

REFERENCE TO RELATED APPLICATION

This application is a division of parent application Ser. No. 464,255 filed Apr. 25, 1974, which is specifically incorporated by reference herein and which issued into U.S. Pat. No. 3,898,792 on Aug. 12, 1975.

BACKGROUND OF THE INVENTION

This invention is related in general to digital timers and in particular to means for effecting operation of the digital timer.

In the past, various types of digital timers were provided with counting or time indicating wheels or drums which were drivingly interconnected by various means, such as a geneva or mutilated gear, to indicate at least hours, tens-of-minutes, and minutes viewable through windows or the like provided at predetermined positions with respect to the drums. In many of the past digital timers, a synchronous timing motor was drivingly interconnected with the minute drum (or a second indicating drum) to effect the digital time indicating function of the drums. In addition, various means for manually resetting the drums to indicate a selected digital time were also provided in some of the past digital times. The past digital timers were of various constructions and sizes, and one criteria was to miniaturize or make the digital timer as small as possible since, in many installations therefor, space was at a premium. One of the disadvantageous or undesirable features of at least some of the past digital timers was that if the operator or user did not make the exact correct time setting of the time indicating drums, the digits thereon would not index into their respective digital time viewing windows accurately. Another disadvantageous or undesirable feature of some of the past digital timers was that due to gear backlash in the gear train or the like for driving the time indicating drums, the operator or user may have set the digital time accurately but lag in the gear train produced inaccurate positioning of the digits on the time indicating drum at the respective windows thereof. Yet another disadvantageous or undesirable feature of some of the past digital timers was that they were inordinately large with respect to the relatively small operating spaces provided therefor in some of the current miniaturized assembly or manufacturing applications for such digital timers.

SUMMARY OF THE INVENTION

Among the several objects of the present invention may be noted the provision of a digital timer and a method of operating a digital timer which overcome the aforementioned disadvantageous or undesirable features, as well as others, with respect to the past digital timers; the provision of such digital timer and method in which a digital time indicating means is generally maintained against slippage from a respective time indicating position thereof at a selected location in the timer by means associated with means for driving the indicating means; the provision of such digital timer and method which provide for automatically releasing the drive of the driving means for the digital timer upon the occurrence of a certain or preselected condition; the provision of such digital timer and method which not only maintains the digital time indicating means against slippage from the time indicating positions thereof at the selected location in the timer but also at least momentarily isolates the drive of the digital timer from the digital time indicating means thereof upon the occurrence of a preselected condition; and the provision of such digital timer which is simplistic in design, economically manufactured, and easily assembled.

In general, a digital timer in one form of the invention has means operable generally for indicating digital time, and means is provided for actuating the indicating means to effect the digital time indicating operation thereof. A drive train for connection with the actuating means includes means adapted to be intermittently rotatable, means for driving the rotatable means in a predetermined time sequence to effect the intermittent rotation thereof, and means for translating the intermittent rotation of the rotatable means to the actuating means.

Also in general and in one form of the invention, a digital timer has means operable generally for indicating digital time and means for actuating the indicating means to effect the time indicating operation thereof. Means is provided for driving the actuating means, and means is disposed between the actuating means and the driving means for transmitting the drive thereof to the actuating means and for automatically releasing the drive of the driving means upon the occurrence of a preselected condition.

Further in general and in one form of the invention, a digital timer has means operable generally at a selected location in the timer for indicating digital time, and the digital timer also has a drive train. Means is driven by the driven train for actuating the indicating means toward digital time indicating positions at the selected location. Means is associated with a part of the drive train and the actuating means for generally maintaining the indicating means against slippage from the respective digital time indicating positions thereof at the selected location and for automatically releasing the drive of the drive train upon the occurrence of a preselected condition.

Still in general, a method is provided in one form of the invention for operating a digital timer having a drive train and at least one means operable generally for indicating digital time at a selected location in the timer. This method comprises the steps of: actuating the drive train and effecting the digital time indicating operation of the at least one indicating means; and releasing automatically the drive of the drive train upon the occurrence of a mechanical condition with respect to the at least one indicating means inhibiting the digital time indicating operation thereof.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting to in any manner to the scope of the invention.

DETAILED DESCRIPTION OF THE PREFERRED EMBODIMENTS

Figure 1:
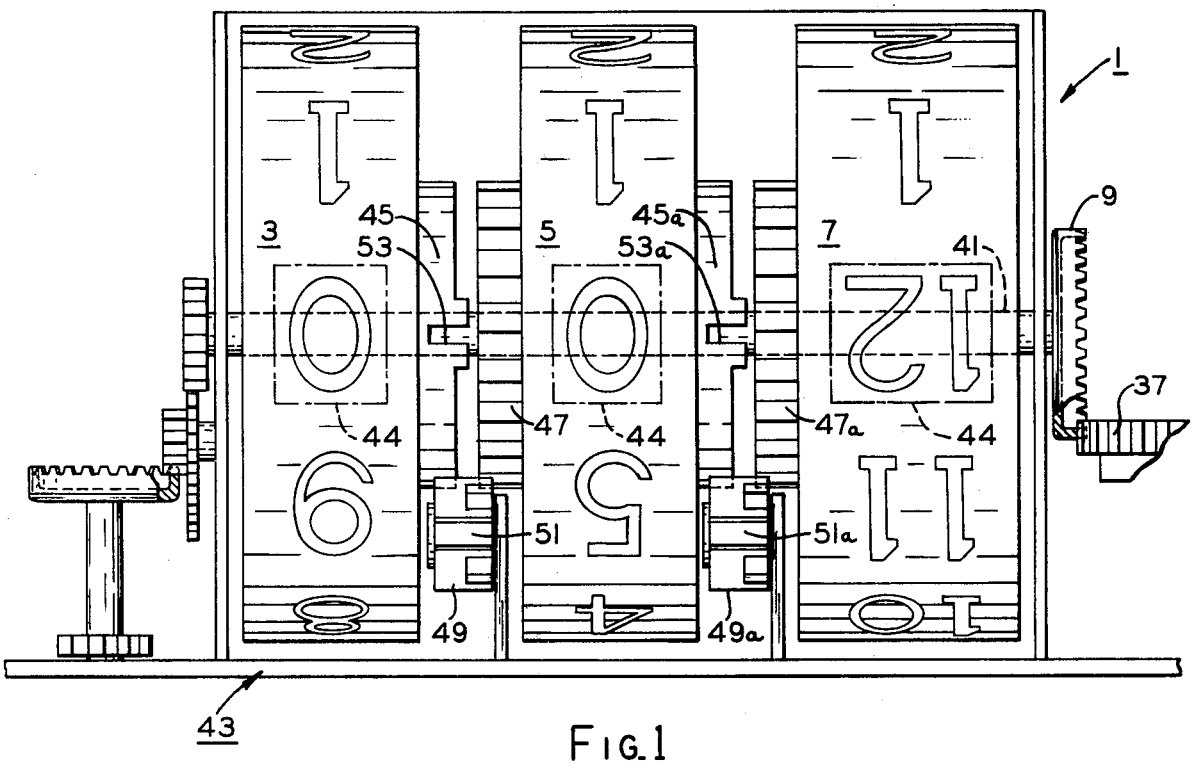
FIG. 1 is a front elevational view of time indicating drums for a digital timer in one form of the invention and such digital timer teaching principles of a method of operating such also in one form of the invention.
Figure 2:
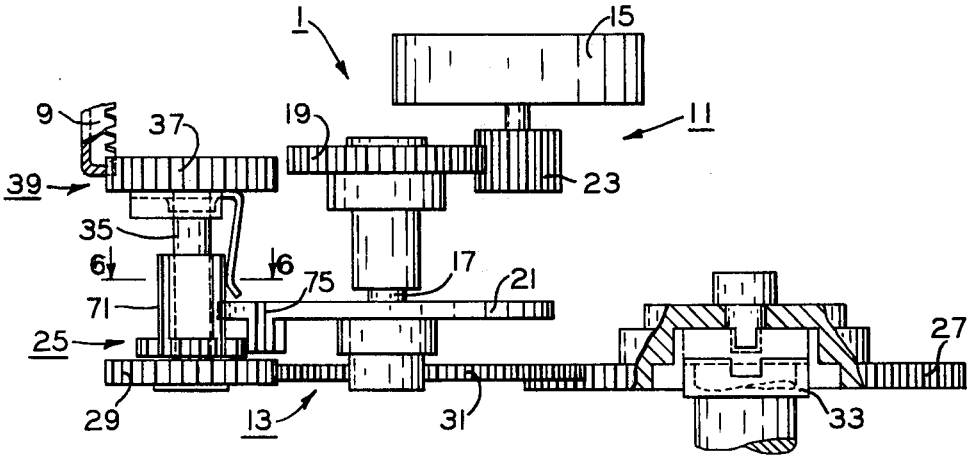
FIG. 2 is a front elevational view of a drive train and resetting train of the digital timer of FIG. 1.
Figure 3:
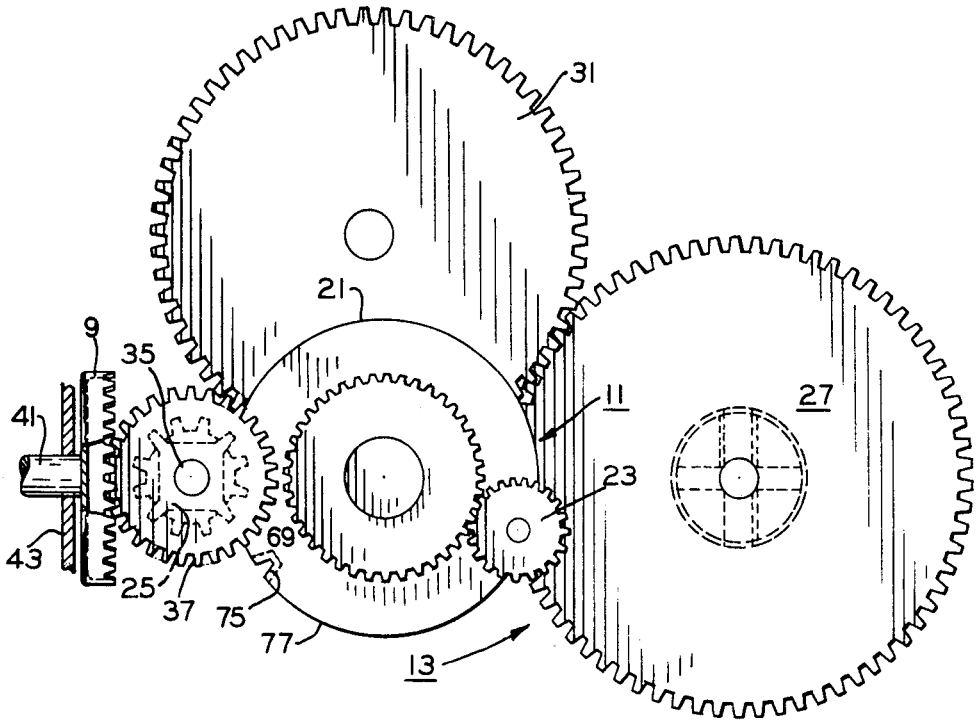
FIG. 3 is a plan view of the drive train and the resetting train of FIG. 2.

Referring now to the drawings in general, there is illustrated in one form of the invention a digital timer 1 having means, such as a plurality of digital time indicating drums 3, 5, 7, for indicating digital time (FIG. 1). Means, such as at least a face or crown gear 9 or the like, for actuating or effecting the time indicating operation of drums 3, 5, 7 is connected therewith. A drive or gear train, indicated at 11, is actuated for intermittently driving the operation effecting means or gear 9 and for conjointly driving in idling relation a resetting or gear train, indicated generally at 13, which is manually operable for driving drums 3, 5, 7 through gear 9 to selected digital time indicating positions (FIGS. 2 and 3). Drive train 11 is released from gear 9 upon the manual operation of resetting train 13 for driving drums 3, 5, 7 through the gear to the selected digital time indicating positions thereof independently of the drive train.

More particularly and with specific reference to FIGS. 1–3, a synchronous or timing motor 15 of a type well known in the art is provided for actuating drive train 11 at a predetermined rate of speed. Typically this type of synchronous motor will operate at a speed of approximately one to three revolutions per minute. Drive train 11 includes at least a drive shaft 17 which carriers a reduction gear 19 and an impulse gear segment 21, and a motor pinion 23 is drivingly engaged with the reduction gear while the impulse segment intermittently drives a mutilated geneva pinion or gear 25 in a predetermined time relation or sequence, as discussed in detail hereinafter. Of course, mutilated gear 25 comprises means adapted to be intermittently rotatable, and impulse gear segment 21 comprises means for driving the rotatable means or mutilated gear in a predetermined time sequence to effect the intermittent rotation thereof.

Resetting train 13 is provided with a time set gear 27 which drives a pinion gear 29 through an idler gear 31. A time set shaft 33 is adapted to be manually moved into rotatable driving engagement with time set gear 27 for manually actuating or operating resetting train 13 to effect the resetting of drums 3, 5, 7 to the selected time indicating positions, as discussed in greater detail hereinafter. Resetting train 13 is connected with gear 9 through a drive shaft 35 which carries pinion gear 29 adjacent the lower end thereof and another pinion or driven gear 37 is carried adjacent the upper end of the drive shaft in driving or meshing engagement with gear 9. Geneva pinion 25 of drive train 11 is mounted for relative rotation on drive shaft 35.

A clutch mechanism or device, indicated generally at 39, is interposed between driven gear 37 and drive and resetting trains 11, 13 so that the drive and resetting trains are mechanically interconnected generally in parallel relation. Resetting train 13 normally is idly driven by drive train 11 through clutch device 39; however, when the resetting train is manually driven by the driving engagement of reset shaft 33 with time set gear 27, as previously mentioned, the clutch device momentarily releases the drive of the drive train. It may be noted that clutch device 39 is also operable automatically to at least momentarily release the drive of drive train 11 in the event of the occurrence of a certain mechanical or preselected condition, such as for instance any malfunction of the component parts of digital timer 1 generally between the clutch device and drums 3, 5, 7 which might lock them or otherwise inhibit the digital time indicating operation or rotation thereof. Of course, the manual operation of resetting train 13 drives driven gear 37 through shaft 35, and in turn, the driven gear drives gear 9 to effect the resetting movement or rotation of time indicating drums 3, 5, 7 to selected digital time indicating positions, as discussed in detail hereinafter. In view of the above, it is apparent that pinion gear 37, shaft 35, and clutch device 39 generally comprise means for controlling the operation of indicating means 3, 5, 7 in response to the drive of drive train 11, and the clutch device generally comprises means for or translating the drive of the driving means or drive train to the indicating means and means for releasing automatically the drive of the drive train upon the resetting operation of the resetting train 13 or upon a mechanical malfunction in digital timer 1 so as to inhibit the time indicating operation of the indicating means, as previously mentioned.

Figure 5:
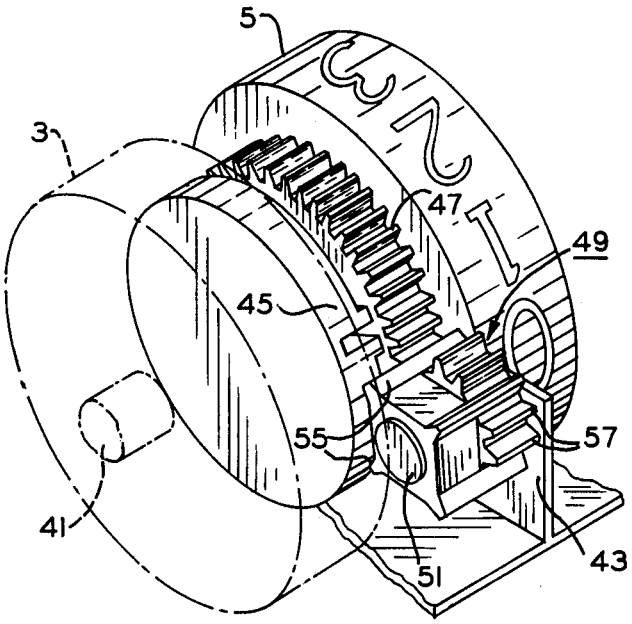
FIG. 5 is a partial perspective view illustrating a coupling for interconnecting the time indicating drums of FIG. 1.

Digital timer 1, as shown in FIG. 1, is provided with a rotatable member, such as a rod or shaft 41, and drums 3, 5, 7 are rotatably mounted on the rod and adapted to be driven or actuated thereby for indicating digital time. A support or housing, indicated generally at 43, is provided in which opposite end portions of rod 41 are rotatably received or mounted. Drum 3 is a minute wheel or counter and is adapted to carry numerals from 0 to 9; drum 5 is a tens-of-minute wheel or counter and is adapted to carry a dual set of numerals from 0–5; and drum 7 is an hour wheel or counter and is adapted to carry numerals from 1 to 12. Of course, the numerals on drums 3, 5, 7 are adapted to align with windows 44 provided in housing 43 as shown in phantom in FIG. 1. Drums 3, 5, 7 are rotatably mounted on rod 41, and drum 3 is secured by suitable means (not shown) to the rod for conjoint rotation therewith. Drums 3, 5 are respectively provided with impulse gear segments **45, 45*a* which may be integrally formed therewith, and drums 5, 7 are respectively provided with ring gears 47, 47*a* disposed adjacent and generally opposite to impulse gear segments 45, 45*a*. Ring gears 47, 47*a* may also be integrally formed with drums 5, 7, respectively. A pair of like mutilated or geneva pinions or gears 49, 49*a* are rotatably mounted on shafts 51, 51*a* which are respectively secured to support 43 by suitable means (not shown) between drums 3, 5, and 5, 7. For the sake of brevity and clarity, only the mutilated pinion 49 for engagement with impulse gear segment 45 and ring gear 47 of drums 3, 5 is shown in greater detail in FIG. 5; however, the impulse gear segment, ring gear, and mutilated pinion disposed between drums 5, 7** are indicated by the subletter "*a*". Impulse gear segments **45, 45*a* are provided with single recesses, 53, 53*a* defined between adjacent half-tooth forms, and the recesses are adapted to mesh with or receive gear teeth 55, 55*a* of mutilated pinions 49, 49*a*. Gear teeth 57, 57*a*** of mutilated pinions 49, 49*a* are adapted to mesh with or receive the teeth of ring gears 47, 47*a*. In this manner, conjoint rotation of drum 3 with rod 41 effects intermittent driving engagement of recess 53 in impulse gear segment 45 with a cooperating tooth 55 of mutilated pinion 49, and in turn, teeth 57 of the mutilated pinion mesh with teeth of ring gear 47 to intermittently drive or rotate drum 5 about rod 41. This intermittent rotation of drum 5 effects intermittent driving engagement of recess 53*a* in impulse gear segment 45*a* with a cooperating tooth 55*a* of mutilated pinion 49*a*, and in turn teeth 57*a* of the mutilated pinion intermittently mesh with teeth of ring gear 47*a* to intermittently drive or rotate drum 7 about rod 41 (as best seen in FIG. 1). It may be noted that the number of teeth on ring gears 47, 47*a*, mutilated pinions 49, 49*a* and the number of recesses 53, 53*a* on impulse gear segments 45, 45*a* may be selected to establish a predetermined time relation or sequence with respect to the relative driven rotation of drums 3, 5, 7. The coupling relation of mutilated pinions 49, 49*a* between drums 3, 5 and 5, 7 is described and shown in the Dec. 23, 1965 issue of *Machine Design* on page 125 thereof. Gear 9 is fixedly connected with rod 41 at the rightward end portion thereof, and if desired, other gearing or drives (not shown) may be taken off of the leftward end portion of the rod. Gear 9 on rod 41 is meshed with driven gear 37 thereby to translate the rotation of the driven gear into conjoint rotation of the rod.

Figure 6:
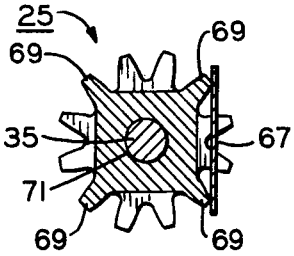
FIG. 6 is a sectional view taken along line 6—6 of FIG. 2.
Figure 7:
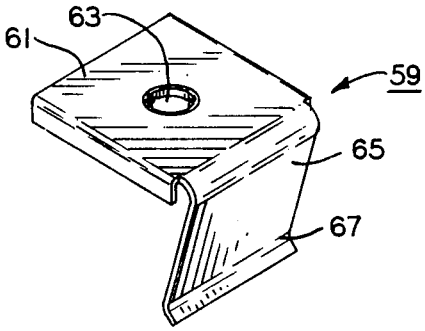
FIG. 7 is a perspective view of a clutch device of FIG. 2.

Referring now to FIGS. 2, 6 and 7, clutch device 39 has a resilient member or spring 59, and a base or generally flat portion 61 of the spring is associated with or disposed in abutting engagement with the lower side of driven gear 37. An opening 63 is provided in base portion 61 through which drive shaft 35 is received in press-fit or other displacement preventing engagement so that spring 59 and driven gear 37 are conjointly rotatable. A depending spring or clutch arm 65 is integrally formed with base portion 61 and has a free end portion 67 which is resiliently urged into clutching or releasable engagement between at least one pair of adjacent teeth or opposite abutments 69 provided on geneva gear 25. It may be noted that the releasable engagement of clutch arm 65 with adjacent teeth or abutment means 69 on geneva gear 25 serves to positively maintain drums 3, 5, 7 in their respective digital time indicating positions by compensating for any backlash which may be created in the drive train 11 or resetting train 13. If desired, it is contemplated within the scope of the invention that another depending spring arm may be integrally formed on base portion 61 opposite spring arms 65 for releasable engagement with another pair of adjacent teeth or opposite abutments 69 of geneva gear 25 opposite to those with which spring arm 65 is engaged.

Referring now to the drawings in general and recapitulating at least in part, it may be noted from the foregoing discussion that digital timer 1 in one form of the invention has means, such as drums 3, 5, 7, operable generally at a selected location, such as windows 44, for indicating digital time (FIG. 1), and means, such as at least clutch 39 and geneva gear 25, is provided for intermittently driving the indicating means or drums toward digital time indicating positions at the selected location or windows (FIG. 2). The driving means includes means, such as resilient arm 65 of clutch 39, releasably engaged with another part, such as geneva gear 25, of the driving means for generally maintaining the drums against slippage from the respective digital time indicating positions thereof at the selected location (FIGS. 1 and 2).

More particularly, geneva gear 25, as best seen in FIGS. 2 and 6, is provided with a bore 71 therethrough, and the bore is rotatably received on drive shaft 35 so as to effect relative rotation between the geneva gear and the drive shaft. Opposite pairs of flats 73 are provided on the peripheral portion of geneva gear 25, and teeth 69, for indexing or abutting engagement with clutch arm 65, as previously mentioned, extend generally lengthwise of the geneva gear between adjacent pairs of flats 73.

Figure 4:
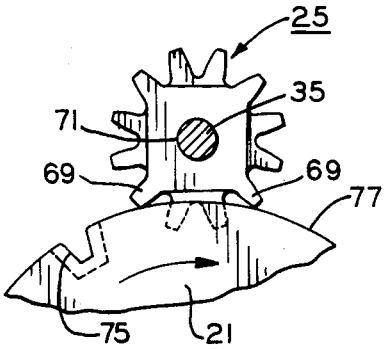
FIGS. 4, 4*a* and 4*b* are respectively enlarged fragmentary views taken from FIG. 3 and illustrating coaction between gearing of the drive train for effecting intermittent rotation of the time indicating drums.
Figure 4A:
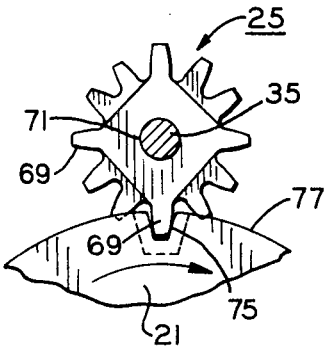
Figure 4B:
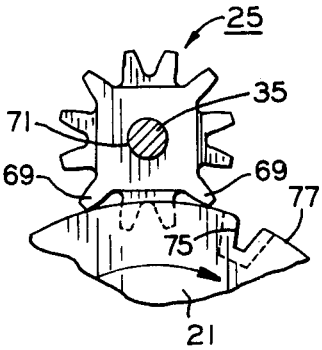

Impulse gear segment 21 of drive train 11 is provided with a recess 75 in the peripheral portion 77 thereof between adjacent half-tooth forms for intermittent driving or meshing engagement with the teeth 69 of geneva gear 25, as illustrated in FIGS. 4, 4*a* and 4*b*. Adjacent pairs of teeth 69 on geneva gear 25 are adapted to engage peripheral portion 77 of impulse segment 21 so as to prevent rotation of the geneva gear with the impulse segment throughout a predetermined part of its rotation, as shown in FIG. 4. As the rotation of impulse gear segment 21 advances its recess 75, the recess engages a geneva gear tooth 69 to conjointly drive or rotate geneva gear 25 with the impulse segment through another predetermined part of its rotation, as shown in FIGS. 4*a* and 4*b*. Upon further rotation of impulse gear segment 21, recess 75 thereof is released from its driving engagement with geneva gear tooth 69 so that successive adjacent teeth 69 of geneva gear 25 are once again engaged with peripheral portion 77 of the impulse segment, as shown in FIG. 4*b*. Of course, upon successive revolutions of impulse gear segment 21, recess 75 thereof again drivingly engages tooth 69 of geneva gear 25 to effect further intermittent drive or rotation thereof, as previously described. It may be noted that the engagement of spring arm 65 of clutch device 39 with adjacent teeth 69 on geneva gear 25, as shown in FIGS. 2 and 6, effects conjoint intermittent rotation or driving of driven gear 37 with geneva gear 25. Of course, such intermittent rotation of driven gear 37 is translated by gear 9 meshed therewith into conjoint intermittent rotation of rod 41 for indexing or effecting intermittent rotation of drums 3, 5, 7 to advance the digital time indication thereof, as described hereinabove. The releasable engagement or connection of spring arm 65 of clutch device 39 with geneva gear 25 also transmits the intermittent movement thereof through drive shaft 35 to resetting train 13 so that it is normally idly driven by drive train 11. From the foregoing, it may be seen that timing motor 15 drives motor pinion 23 at a predetermined speed which is reduced by reduction gear 19 meshed therewith so that impulse gear 21 intermittently drives geneva gear 25 in a predetermined time relation or sequence which is transmitted through clutch device 35, gears 37 and 9, and rod 41 to drums 3, 5, 7, as previously mentioned.

Resetting train 13 is normally idly driven by drive train 11, as previously mentioned, wherein the intermittent drive of driven gear 37 is transmitted through shaft 35 to pinion gear 29 and therefrom through idler gear 31 to time setting gear 27, FIG. 2. In the event it is desirable to reset or move drums 3, 5, 7 to selected digital time indicating positions, time set shaft 33 is manually moved to a position in driving engagement with time set gear 27 and thereafter rotated with a force at least great enough to overcome the clutching engagement of clutch device 39 with geneva gear 25 of driven train 11. When this manual force is applied for time setting gear 27 to actuate or operate resetting train 13, rotation of the time setting gear 27 drives or rotates pinion gear 29 through idler gear 31 meshed therebetween. Driven gear 37 is conjointly rotated or driven with pinion gear 37 through drive shaft 35 connected therebetween, and since clutch device 39 is conjointly rotated with the driven gear, the spring arm 65 of the clutch device is indexed or moved over one of the teeth 69 of geneva gear 25 into releasable engagement with successive teeth 69 thereof. During the indexing rotation of clutch 39 on geneva gear 25, the engagement of successive teeth 69 of the geneva gear with peripheral portion 77 of impulse segment 21, as shown in FIGS. 4 and 4*b* for instance, obviates rotation of the geneva gear during the manual operation of resetting train 13. Of course, rotation of driven gear 37 is translated by gear 9 meshed therewith into conjoint rotation of rod 41 for rotatably driving drums 3, 5, 7 to the selected digital time indicating position. The releasable engagement of clutch device 39 with geneva gear 25 permits operation of resetting train 13 in both the forward and backward or opposite directions for resetting the digitally indicated time.

From the foregoing, it is now apparent that a novel digital timer 1 and a method of operating such have been provided meeting the objects and advantages set out hereinbefore, as well as others, and that changes may be made by those having ordinary skill in the art not only as to the precise arrangements, shapes, connections and details of the construction set forth herein but also with respect to the precise arrangements or order of the steps of the method without departing from the spirit of the invention or the scope thereof which is defined by the claims which follow.

What we claim as new and desire to secure by Letters Patent of the United States is:

1. A digital timer comprising means operable generally for indicating digital time; means for actuating said indicating means to effect the digital time indicating operation thereof; a drive train for connection with said actuating means including a geneva gear adapted to be intermittently rotatable, and means for driving the geneva gear in a predetermined time sequence to effect the intermittent rotation thereof; a plurality of means for abutment disposed on one of said geneva gear and said actuating means; and means associated with the other of said geneva gear and said actuating means for translating the intermittent motion of said geneva gear to said actuating means including means integral with said translating means for abutting engagement with at least one of said abutment means.

2. A digital timer as set forth in claim 1 wherein said driving means comprises a rotatable impulse segment having means drivingly engaged with said geneva gear to effect the intermittent rotation thereof only during a predetermined portion of each revolution of said impulse segment.

3. A digital timer comprising means operable generally for indicating digital time, means for actuating said indicating means to effect the time indicating operation thereof; means for driving said actuating means including a mutilated geneva gear; and a clutch device including resilient means releasably associated with said actuating means and said mutilated geneva gear for transmitting the drive of said driving means from said mutilated geneva gear to said actuating means and said resilient means being indexed with respect to said mutilated geneva gear for automatically releasing said actuating means from the drive of said driving means through said mutilated geneva gear upon the occurrence of a mechanical malfunction inhibiting the time indicating operation of said indicating means.

4. A digital timer as set forth in claim 3 wherein said clutch device further includes means for generally conjoint operation with a part of said actuating means, and said resilient means being connected with said operation means.

5. A digital timer as set forth in claim 3 wherein said mutilated geneva gear includes a plurality of generally successive means on a part thereof for abutment with said resilient means and said resilient means being indexed between said abutment means of said plurality thereof to effect the automatic release of said actuating means from the drive of said driving means upon the occurrence of the mechanical malfunction.

6. A digital timer as set forth in claim 3 wherein said clutch device further includes a base connected with said actuating means, and said resilient means comprises a resilient arm integral with said base and extending therefrom toward engagement with said mutilated geneva gear so as to be indexed thereby.

7. A digital timer comprising a support; means operable generally for indicating digital time; means disposed on said support for mounting said indicating means and actuating said indicating means to effect the digital time indicating operation thereof, said mounting and actuating means including a driven gear, and means for driving said mounting and actuating means including a mutilated geneva gear adapted to be intermittently rotatable; means for drivingly rotating said geneva gear in a predetermined time sequence to effect the intermittent rotation thereof; a driving gear drivingly meshed with said driven gear; and means for connecting said driving gear with said geneva gear including means operable generally for automatically releasing said geneva gear to at least momentarily interrupt the drive of said driving means upon the occurrence of a preselected condition.

8. A digital timer as set forth in claim 7 wherein said drivingly rotating means includes at least an impulse segment having means for driving engagement with said geneva gear to effect the intermittent rotation thereof only during a predetermined portion of each revolution of said impulse segment.

9. A digital timer comprising a support, a rod rotatably mounted on the support, at least one digital time indicating drum mounted on the rod, means for effecting conjoint rotation of the at least one digital time indicating drum with the rod, a gear attached to the rod, another gear drivenly meshed with the first named gear and extending in an operating plane generally angularly disposed with respect to that of the first named gear, a mutilated geneva gear adjacent the other gear and adapted to be intermittently rotated, a clutch device associated with the other gear and the mutilated geneva gear to effect conjoint intermittent rotation of the other gear with the mutilated geneva gear, the clutch device including resilient means for releasable engagement with the mutilated geneva gear and operable generally to at least momentarily release the mutilated geneva gear interrupting the conjoint rotation of the other gear therewith upon the occurrence of a certain condition, and means for driving the mutilated geneva gear in a predetermined time sequence including a rotatable impulse segment, means on the impulse segment for driving engagement with the mutilated geneva gear to effect the intermittent rotation thereof only during a predetermined portion of each revolution of the impulse segment, a timing motor, and a gear train drivingly connected between the timing motor and the impulse segment.

10. A digital timer comprising means operable generally for indicating digital time; means for actuating said indicating means to effect the digital time indicating operation thereof; a drive train for connection with said actuating means including means adapted to be intermittently rotatable, and means for driving said rotatable means in a predetermined time sequence to effect the intermittent rotation thereof; a plurality of means for abutment disposed on one of said rotatable means and said actuating means, and means associated with the other of said rotatable means and said actuating means for translating the intermittent rotation of said rotatable means to said actuating means including means integral with said translating means for abutting engagement with at least one of said abutment means, said abutting engagement means comprising resilient means for indexing from said at least one abutment means into the abutting engagement with the others of said abutment means so as to release the drive of said drive train in the event of a malfunction of said indicating means inhibiting the digital time operation thereof.

11. A digital timer comprising means operable generally for indicating digital time; means for actuating said indicating means to effect the digital time indicating operation thereof; a drive train for connection with said actuating means including means adapted to be intermittently rotatable, and means for driving said rotatable means in a predetermined time sequence to effect the intermittent rotation thereof; a plurality of means for abutment disposed on one of said rotatable means and said actuating means; and a clutch device associated with the other of said rotatable means and said actuating means so as to translate the intermittent rotation of said rotatable means to said actuating means including means integral with said clutch device for abutting engagement with at least one of the abutment means, said abutting engagement means comprising a resilient arm having a portion disposed in the abutting engagement with said at least one abutment means, said portion of said resilient arm being indexed into the abutting engagement with the others of said abutment means so as to effect the release of said drive train in the event of a malfunction inhibiting the digital time indicating operation of said indicating means.

12. A method of operating a digital timer having a drive train including a mutilated geneva gear, and at least one means operable generally for indicating digital time at a selected location in the timer, the method comprising the steps of:

a. actuating the drive train and effecting the digital time indicating operation of the at least one indicating means through a resilient arm of a clutch device operably connected between the at least one indicating means and the mutilated geneva gear; and b. indexing the resilient arm of the clutch device about a plurality of associated abutments therefor on the mutilated geneva gear and thereby releasing automatically the drive of the drive train upon the occurrence of a mechanical condition with respect to the at least one indicating means inhibiting the digital time indicating operation thereof.

13. A method of operating a digital timer comprising the steps of:

a. driving at least one means operable generally for indicating digital time at a selected location in the digital timer;

b. automatically releasing a clutch device operable generally for transmitting the drive of a drive train to the at least one indicating means during the driving step so as to at least momentarily interrupt the transmission of the drive of the drive train to the at least one indicating means in the event of the occurrence of a condition mechanically inhibiting the digital time indicating operation of the at least one indicating means.

14. A method of operating a digital timer having a drive train and an actuating train including means operable generally for indicating digital time at a selected location therefor in the timer, the method comprising the steps of:

a. driving the actuating train through the drive train and effecting the digital time indicating operation of the indicating means; and b. automatically releasing from the actuating train the drive of the drive train in the event of a mechanical malfunction in the actuating train inhibiting the digital time indicating operation of the indicating means.

* * * * *